US007197964B2

(12) United States Patent
Buchanan

(10) Patent No.: US 7,197,964 B2
(45) Date of Patent: Apr. 3, 2007

(54) WRENCH

(75) Inventor: Nigel Alexander Buchanan, Fife (GB)

(73) Assignee: Smart Tools Ltd., Arbroath, Angus, Scotland (GB)

( * ) Notice: Subject to any disclaimer, the term of this patent is extended or adjusted under 35 U.S.C. 154(b) by 0 days.

(21) Appl. No.: 10/550,825

(22) PCT Filed: Mar. 25, 2004

(86) PCT No.: PCT/GB2004/001312

§ 371 (c)(1),
(2), (4) Date: May 18, 2006

(87) PCT Pub. No.: WO2004/085116

PCT Pub. Date: Oct. 7, 2004

(65) Prior Publication Data

US 2006/0236818 A1 Oct. 26, 2006

(30) Foreign Application Priority Data

Mar. 25, 2003 (GB) ..... 0306826.9

(51) Int. Cl.
*B25B 13/04* (2006.01)
*B25B 13/52* (2006.01)
*B25B 13/46* (2006.01)

(52) U.S. Cl. ..... 81/58; 81/64

(58) Field of Classification Search ..... 81/58, 81/64, 53.2

See application file for complete search history.

(56) References Cited

U.S. PATENT DOCUMENTS 620,461 A * 2/1899 Lambkin ..... 408/121
1,536,011 A * 4/1925 Jones et al. ..... 81/58.5
1,664,391 A * 4/1928 Aschroft ..... 81/58
2,764,049 A * 9/1956 Hartung ..... 81/58
2,766,648 A * 10/1956 Jazwieck ..... 81/58
2,824,476 A * 2/1958 Wilson ..... 81/58
2,846,910 A * 8/1958 Brown ..... 81/64
3,656,376 A * 4/1972 Campbell et al. ..... 81/58
3,969,962 A * 7/1976 Campbell ..... 81/60
6,016,723 A * 1/2000 Hillinger ..... 81/63.1
2005/0061115 A1* 3/2005 Duffy et al. ..... 81/64
2005/0247168 A1* 11/2005 Buchanan ..... 81/64
2005/0268751 A1* 12/2005 Buchanan ..... 81/64

FOREIGN PATENT DOCUMENTS

BE 384487 A 12/1931
DE 2522696 A1 12/1976
GB 387590 A 2/1933
GB 2211771 A 12/1989
GB 2391504 A 11/2004

* cited by examiner

*Primary Examiner*—David B. Thomas
(74) *Attorney, Agent, or Firm*—Ostrager Chong Flaherty & Broitman P.C.

(57) ABSTRACT

A wrench (1) is disclosed having a handle (3) mounted pivotally with a head portion (2) for engaging a drive socket to tighten or slacken a fastener such as a nut, bolt or screw, and a resilient split ring (5) as operative portion intermediate the handle (3) and head portion (2). The head portion (2) has an aperture into which the split ring (5) is sprung to define a radial gap in the split ring (5) and a camming arm (33, 34) extending radially outwardly from each end of the split ring (5) respectively. The split ring (5) also has stops (37, 38) engaging the head portion under the natural resilience in the split ring (5) to prevent undue rotation of the ring in the head portion.

14 Claims, 4 Drawing Sheets

Fig 3
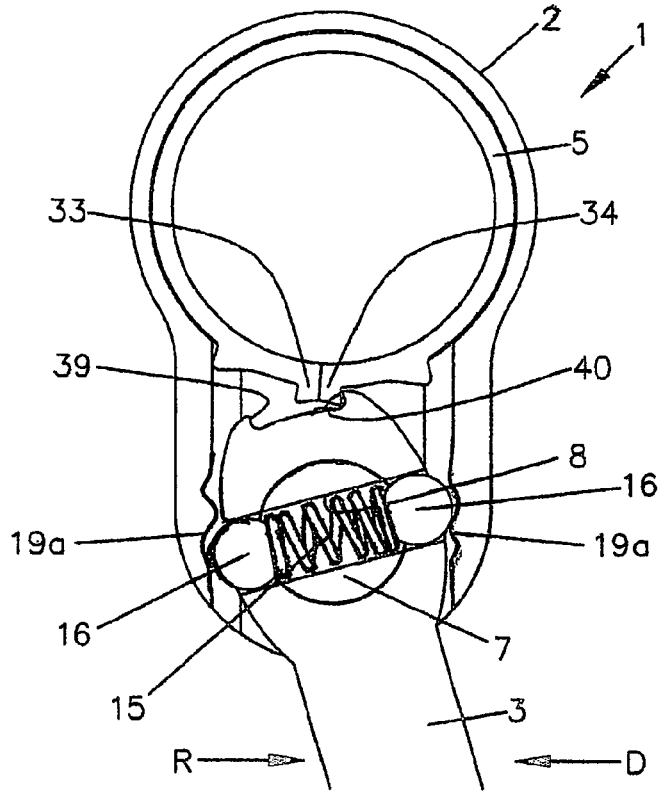
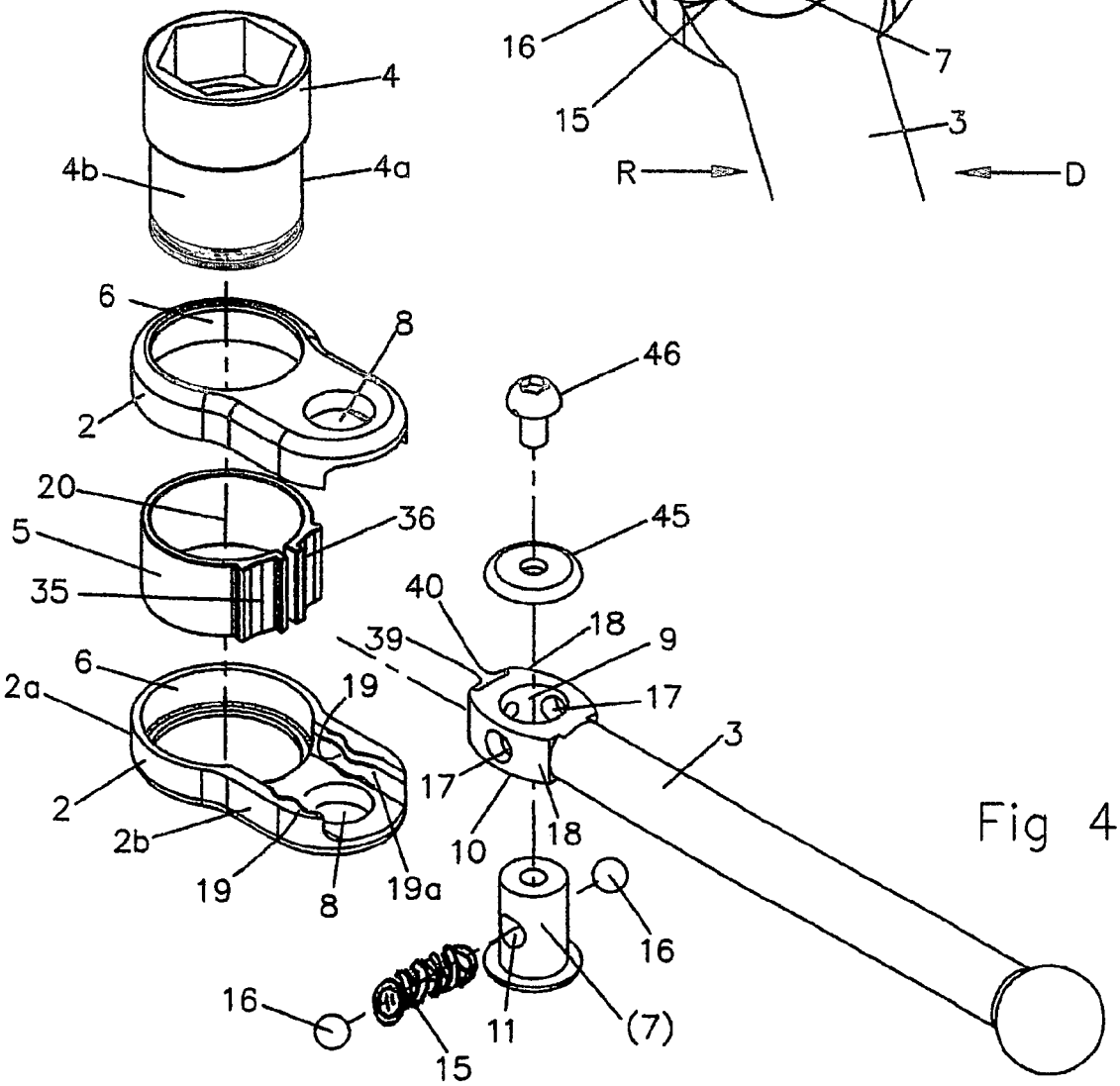
Fig 4

Fig 6
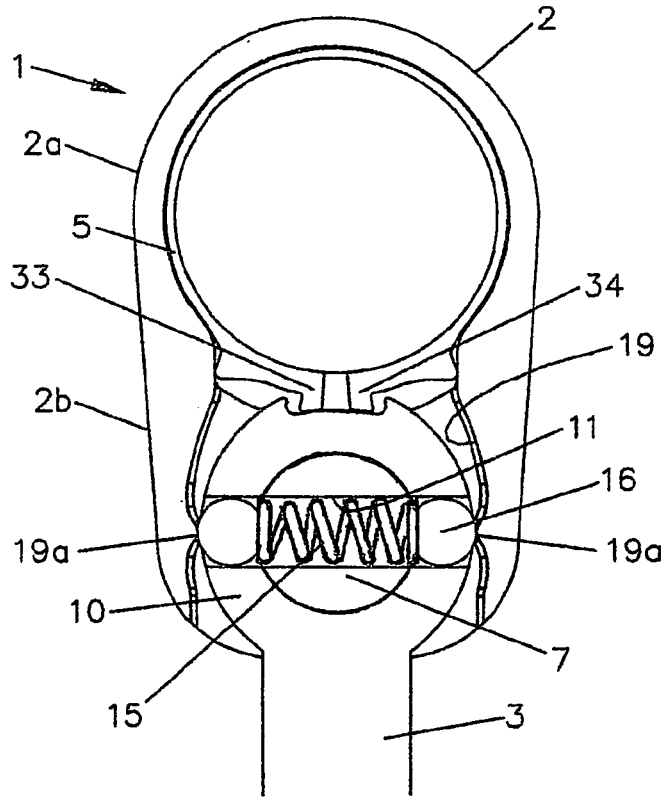
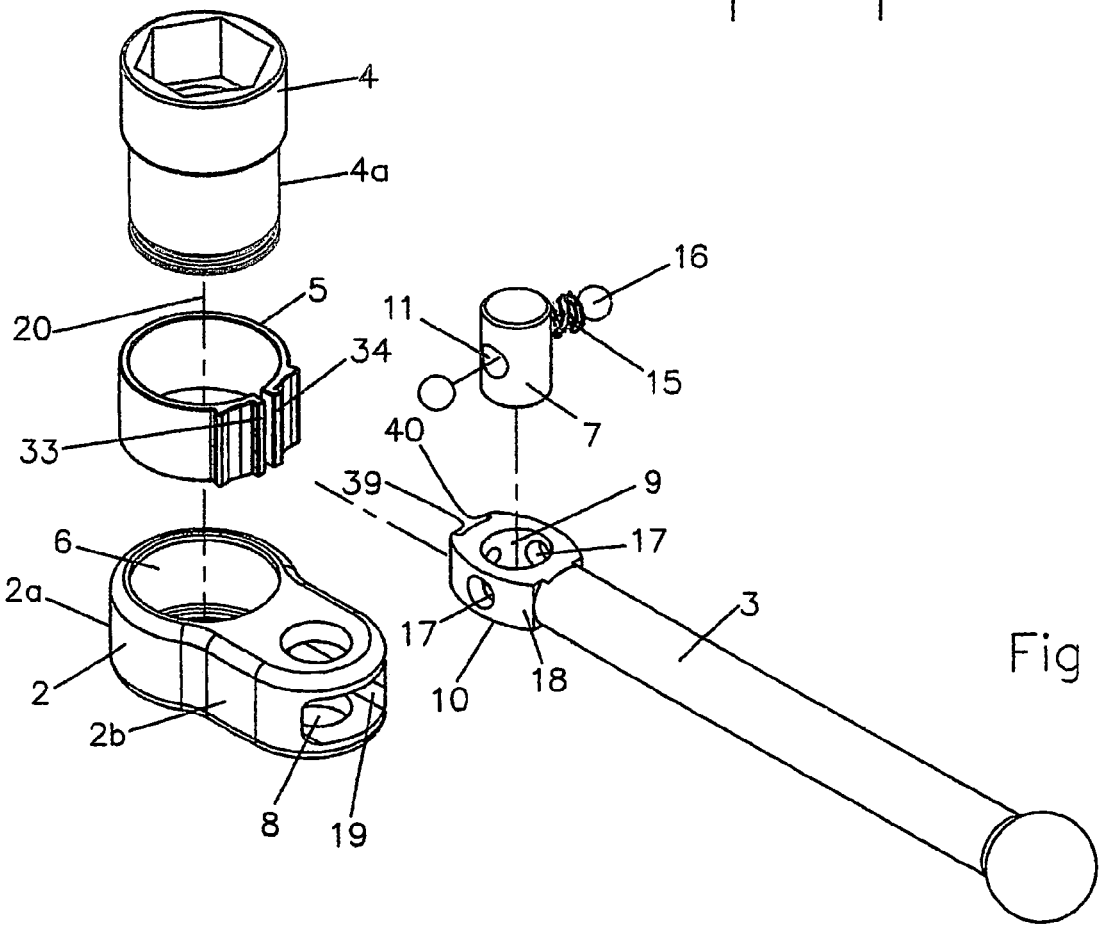
Fig 5

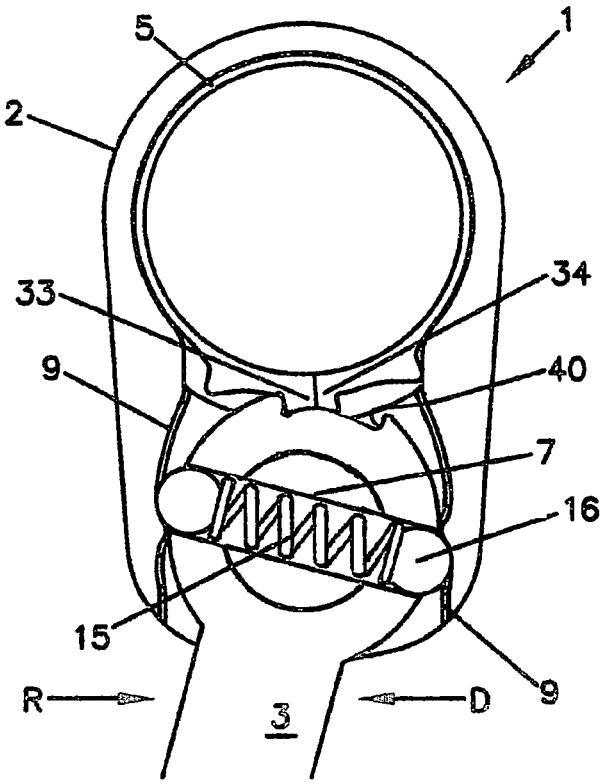
Fig 7
Fig 8
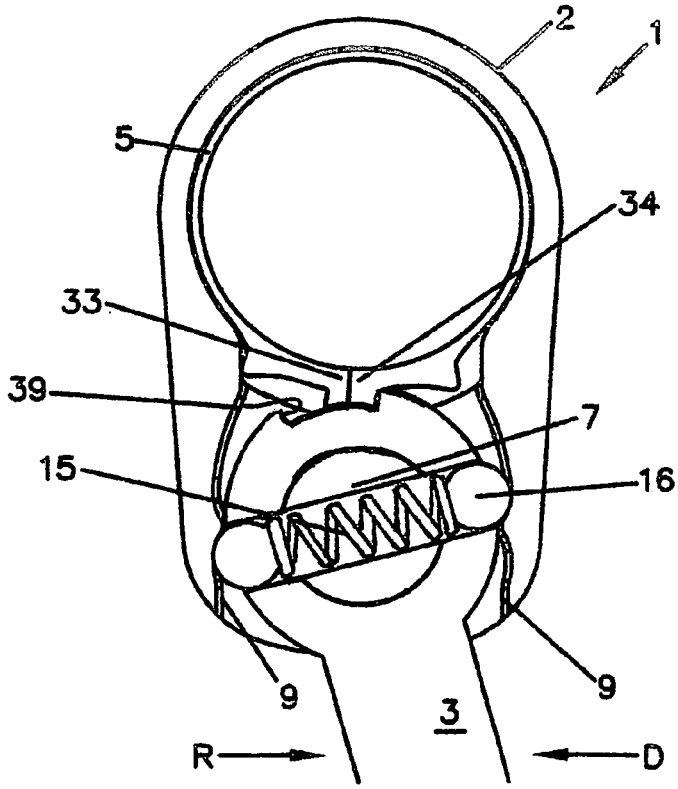

WRENCH

FIELD OF THE INVENTION

The present invention relates to a wrench having at least a one way operation and more particularly, though not exclusively, concerns a tool similar in operation to a ratchet like tool having a ratchet bar.

BACKGROUND OF THE INVENTION

Ratchet tools are well known and are a tool suitable for applying torque to a fastener such as a nut, bolt or screw, via an appropriate drive socket (hereinafter also referred to as a fastening device) having a square drive recess which receives a square peg of a ratchet bar, for the purpose of tightening or slackening the fastener. The wrench or ratchet tool is movable relative to the fastening device in one direction only opposite to that direction in which torque is applied. Motion between the ratchet bar and the fastening device in the opposite direction is achieved by a set of angular teeth, which co-operate with a pawl to create a locking motion in the one direction only for applying torque and free movement in the opposite direction. The operation of the fastening device and fastener via a ratchet bar is much more convenient in restricted space situations than the use of a fixed bar operated socket because there is seldom a requirement to remove and reattach the fastening device operating the fastener.

Variations of known ratchet bar arrangements are exhaustive. Most mechanisms have more and more locking teeth etc. to allow a smaller angle between drive, re-position and drive, resulting in mechanisms in which the angle between drive and reposition has been substantially reduced, but as a result so has the amount of torque that can be safely applied to the ratchet bar without failure. The increasing intricacies of the ratchet mechanisms have resulted in them being intolerant to dirt or corrosion.

SUMMARY OF THE INVENTION

It is an object of the present invention to provide an improved one directional drive device in particular a fastening device.

According to one aspect of the present invention there is provided a wrench comprising a head portion defining a circular aperture, a split ring sprung into said aperture and having spaced-apart end portions and a handle pivotally coupled to said head portion for moving said end portions together, said split ring having an abutment portion and a camming portion, said abutment portion being adapted to cooperate with a complementary abutment portion formed in said head portion to limit the available rotation of the split ring within the aperture, and said camming portion being adapted to cooperate with a complementary part on said pivotal lever for moving the spaced-apart end portions of the split ring towards each other when said abutment portion of the split ring is abutting the complementary abutment portion on the head portion, and spring means biasing said handle in a sense to close said spaced apart end portions of the split pin together with a force greater than the spring force developed by the split ring itself.

In a preferred embodiment of the present invention the spring means biasing the handle is located in the handle at the coupling between the head portion and the handle.

Preferably, the spring means is located in a passage extending through the coupling and complimentary apertures in the handle.

Opposed ends of the spring means may be associated with detent means.

Conveniently, the detent means comprises a ball located at each of the two opposed ends of the spring means, respectively, for engagement with a respective protrusion on the head portion.

Each protrusion may extend towards the other in an elongate slotted portion of the head portion in which an end portion of the handle is coupled to the head portion.

The wrench may include two recesses on either side of each protrusion for receiving therein a respective one of the balls when the handle is in a drive or a reverse drive position.

The spring means is conveniently a compression spring.

Preferably, the complimentary part on said pivotal lever for moving the spaced apart end portions of the split ring towards each other comprises end walls of a slot at the inner-most end of the handle within the head portion, the slot extending in a transverse direction to a longitudinal axis of the handle.

The spaced apart end portions of the split ring may comprise a land extending in both a radially outward direction and a circumferential direction, to define a common protrusion contiguous the split in the ring and the abutment portion at the circumferentially opposed end of the land to the respective camming portion, wherein the camming portions project into the transverse slot of the handle.

DESCRIPTION OF THE INVENTION

Embodiments of the present invention will now be described by way of example only with reference to the accompanying drawings in which:

FIG. 3 is a similar view of the clamp drive socket bar of FIG. 1, but in a reverse drive position;

FIG. 4 is an exploded view of the clamp drive socket bar of FIG. 1 with a fastening device shown to be locatable within a flexible ring;

FIG. 5 is an exploded view similar to FIG. 4 showing a modified form of the clamp drive socket bar, FIG. 6 is a partial plan view of a wrench similar to FIG. 1, but of another embodiment in accordance with the invention;

FIG. 7 is a view similar to FIG. 2, but of the wrench of FIG. 6; and FIG. 8 is a view similar to FIG. 3, but of the wrench of FIG. 6.

DESCRIPTION OF THE EMBODIMENTS

Figure 1:
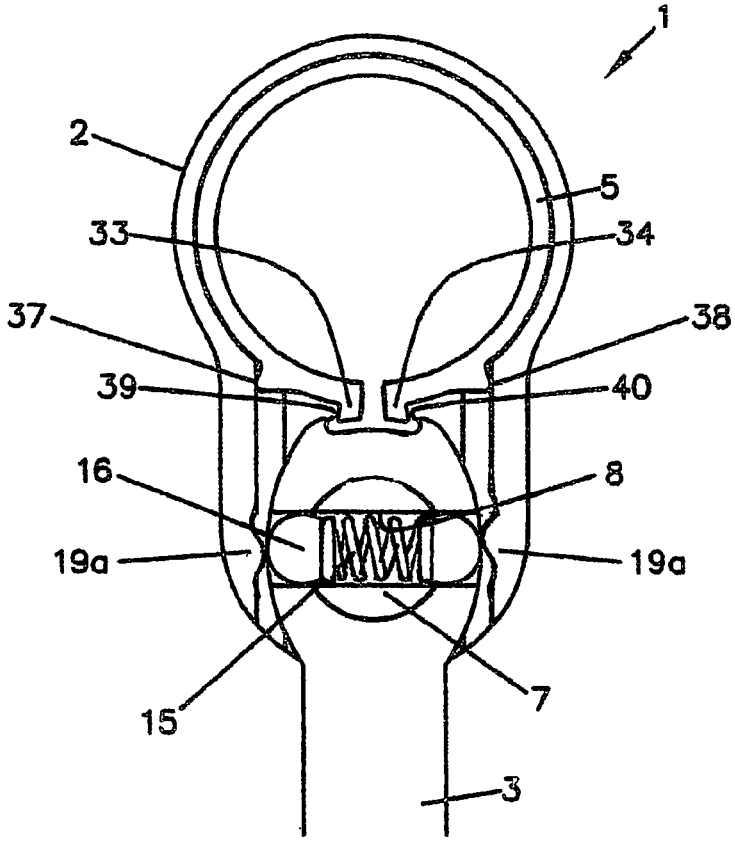
FIG. 1 is a partial plan view of a wrench in accordance with the present invention having a clamp drive socket bar with a resilient drive ring located within a casing of a head of the socket bar.

The embodiments of the present invention will now be described with reference to the accompanying drawings. In the various embodiments described herein and corresponding drawings, like reference numerals are used to indicate like features throughout.

Referring to FIGS. 1 to 4 of the drawings, there is shown a wrench having a clamp drive socket bar (1) which includes a head portion (2) formed of steel for example and coupled with an elongate handle (3) for applying torque to a drive spigot (4*a*) of a socket (4) having an external cylindrical drive surface (4*b*).

A resilient split ring (5) is spring fitted within the head portion (2) and is so sized that in an inherently expanded condition the split ring engages, in a complementary manner, internal surface (6) of the head portion (2).

A pivot or fulcrum pin (7) is mounted in opposed apertures (8) on opposite sides of the head portion (2) and also extends through aperture (9) through one end (10) of the handle (3) to which the head portion (2) is attached for coupling the head portion (2) and handle (3) so as to be pivotable one relative to the other.

The pivot pin (7) has a diametrically extending cylindrical aperture (11) therethrough. A compression spring (15) and a ball (16) at each opposite end of the spring are located in the cylindrical aperture (11) and extend into diametrically opposed apertures (17) on transverse faces (18) of end (10) of handle (3).

The head portion (2) is shown in FIG. 4 to be of a two part construction to sandwich therebetween the resilient split ring portion (5) in a substantially cylindrical part (2*a*). A slotted part (2*b*) extends radially outwardly from cylindrical part (2*a*) to receive end (10) of handle (3) within the slotted part (2*b*). Parallel opposed surfaces (19) extend in a direction parallel to the central rotational axis (20) of aperture (21) through head portion (2) for receiving spigot (4*a*) of the socket fastener device (4).

The parallel surfaces (19) are each provided with a smooth curved protrusion (19*a*) aligned with and directed towards the other. The protrusions are located as shown in FIG. 1 to act simultaneously on opposed balls (16) to compress spring (15).

As shown in FIG. 4 the flexible ring (5) has a generally radially extending gap (30) between opposed ring ends (31) and (32) thereof. An elongate camming arm (33) extends in a radial direction outwardly from ring end (31) and a similar camming arm (34) extends in a radial direction outwardly from ring end (32). The two camming arms (31) and (32) are closely spaced one from the other by gap (30) in an inoperative condition of the clamp drive socket bar (1) as shown in FIG. 1.

A radially outwardly extending land (35,36) extends a short distance circumferentially from arms (33, 34), respectively. The lands extend between the opposed parallel surfaces (19) defining the slot in the slotted part (2*b*) of the head portion. The lands each have a flat end abutment surface (37,38) remote from camming arms (33,34), respectively, for engaging when necessary respective surfaces (19) of the slotted portion (2*b*) of the head. Abutment surfaces (37,38) are both engagable with the respective surfaces (19) in the central non-operative position of the wrench as shown in FIG. 1.

Complementary surfaces (39,40) at the outermost end (10) of the handle (3) extend in a direction parallel to the longitudinal direction of the handle (3) and in use engage camming arms (33,34), respectively, as necessary, to begin to close gap (30) and subsequently clamp firmly spigot (4*a*) of socket fastening device (4) to rotate the same.

In describing the operation of the device it is to be assumed the wrench is initially in the position shown in FIG. 1 with a spigot (4*a*) of a socket (4) located within the resilient ring (5) in a loose fitting manner. In such case, the inherent spring resilient force within the split ring (5) holds the end surfaces (37,38) against the slot defining surfaces (19) of the head portion (2).

When torque is applied via arm (3) in a drive direction D to tighten a fastener (not shown) engaged by the socket (4) or other fastening device, surface (39) moves to engage camming arm (33) of the split ring (5), and the spring (15) and balls (16) begin to move off the protrusions (19*a*). The spring (15) being of a greater force than the inherent biasing force within the split ring (5) forces the balls (16) to move outwardly down opposite surfaces of the respective protrusions to end finally in the position shown in FIG. 2. In achieving this position the complementary surfaces (39) forces camming arm (33) of the split ring (5) across to the right hand side in FIG. 2 to close or substantially close gap (30) and to abut arm (33) against arm (34). In this position the split ring (5) is in effect automatically locked onto spigot (4*a*) of socket (4). When the handle (3) is released by the operator the force in spring (15), being greater that that in the split ring ensures the wrench is locked onto spigot (4*a*) of socket (4).

When tightening a fastener it is sometimes necessary to move the wrench to a different position, in a reverse direction R, so that torque can be re-applied in drive direction D. In this instance, as arm (3) moves in the reverse direction, surface (39) moves away from camming arm (33) and the spring bias in split ring (5) separates arms (33,34). As soon as separation occurs the clamping effect of the split ring (5) is removed sufficiently to enable free rotation of the wrench about the spigot (4*a*) of the socket (4).

Once the wrench is repositioned in a desired manner and the torque in the reverse direction R is removed, the force of the compression spring (15) again takes over and clamps the wrench via split ring (5) onto the spigot (4*a*), as described above with reference to FIG. 2.

To unscrew a fastener without removing the wrench over requires the operator to hold the head portion (2) while applying toque in the reverse direction R. Once the spring (15) and balls (16) align with the protrusions (19*a*) and more torque is applied in reverse direction R, the handle clicks over centre as the spring (15) forces the balls down the opposite sides of the respective protrusions to the position as shown in FIG. 3. The operation of the wrench to unscrew the fastener will be the same as described for tightening the fastener. However, the split ring will open out to the position of FIG. 1 as the handle moves over centre (that is the balls cross the peaks of the protrusions) and complimentary surface (40) acts upon camming arm (34) to close the split ring and clamp it on spigot (4*a*).

FIG. 4 shows a washer (45) and a screw (46) being used to hold the pivot pin (7) in place relative to the head portion 2. However, the washer and screw, with pivot pin (7), serve also to hold the two parts of the head portion (2) together. In FIG. 5 the pivot pin (7) is simply replaced by a pin having a friction fit for example to help hold the two parts of the housing together. Otherwise the embodiment described in FIG. 5 operates in the same manner as described above in regard to the specific embodiment of FIGS. 1 to 4.

FIGS. 6 to 8 illustrate yet another embodiment in accordance with the present invention. The construction shown is slightly different than previously shown in FIGS. 1 to 4 or FIG. 5. However, the operation of the wrench of FIGS. 6 to 8 is substantially identical to what has previously been described above.

However, the physical differences amount to the end (10) of the handle (3) being substantially annular with the pivot pin (7) occupying the central aperture of the annulus. In addition the surfaces (19) of the slotted portion (2*b*) are no longer parallel but are curved to provide a more pronounced recess on either side of the protrusions thereby to ensure a more positive and faster snap action than the previously described embodiments.

Advantageously, the wrench device of the present invention can operate efficiently to tighten a fastener in situations where there is little space to operate without the need to rely on ratchet teeth. The resilient split ring (5) operates immediately to grip the drive spigot of the fastening device when the handle is moved in direction D. Furthermore, torque increases to grip the drive spigot tighter the more the handle is forced in direction D. Therefore, the chance of slippage is removed whether the drive occurs between two cylindrical surfaces or hexagonal surfaces. Additionally, the wrench can be applied directionally to fasteners of various sizes using the one flexible ring.

When it is necessary to obtain free reverse rotation of the handle so that further drive forces can subsequently be applied, the handle is movable in the reverse direction R immediately releasing the split ring which begins to open under its inherent resilience. Thereby, pressure is released upon the drive spigot of the socket fastening device and the whole wrench can move freely about the spigot to provide sufficient room to apply drive pressure to tighten a fastener. Furthermore, as the reverse force R is released from the handle the compression spring acts as described above to force the handle in the drive D direction and to move the camming means in a direction to close the gap in the split ring thereby gripping the spigot tightly prior to drive torque being applied to further tighten the fastener. Therefore, the compression spring and protrusions provide in effect an automatic clamping upon the spigot in either drive D or reverse drive R directions.

Should it then be necessary to release or untighten the fastener the wrench does not have to be removed from the socket spigot but the head portion held while the handle is moved over centre in reverse direction R, when the abutments (37,38) on the split ring both engage respective surfaces (19) of the head portion and the detent balls (16) are forced pass the protrusion in opposite directions. Immediately the balls (16) pass the protrusions (19*a*) the compression spring (15) forces the balls down the side walls of the protrusions into a recess on either side thereof respectively at the base of the protrusions and in the inside wall (19) defining the slotted portion of the head portion (2). Simultaneously, camming portion (34) is engaged by end surface (40) to move camming portion (34) towards the camming portion (33) to close the split ring about the spigot (4*a*) of the socket (4) whereupon operation for releasing a fastener is the same as for tightening the fastener as described above.

While the preferred embodiments described above are shown to have the protrusions (19*a*) the invention will work in a similar manner in another embodiment where the protrusions are omitted and the surfaces (19) are planar throughout their length. In such embodiment, the handle (3) may be in a central position in which the compression spring is fully compressed and the balls (16) are substantially within recess (11) and apertures (17), and both press outwardly on opposed surfaces (19), respectively.

Figure 2:
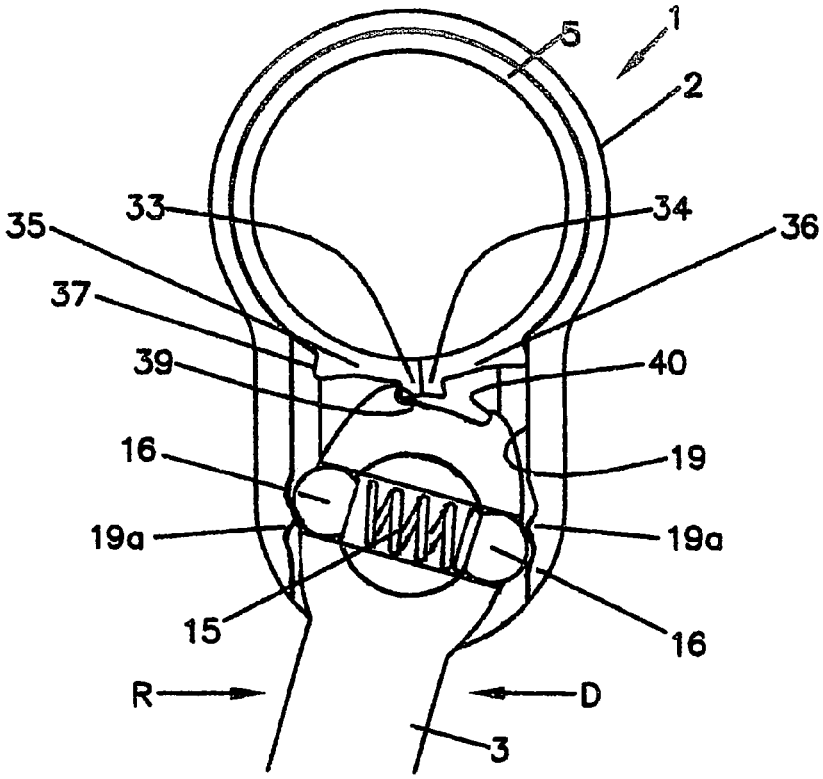
FIG. 2 is a similar view of the clamp drive socket bar of FIG. 1, but shown in a drive position.

When the arm (3) is moved in the drive direction D, see FIG. 2, the compression force in the spring (15) forces the balls outwardly causing them to move a position similar to that in FIG. 2. In taking this action the split ring is forced to be closed automatically as described with reference to FIG. 2.

As a reverse torque is applied in direction R the spring (15) is compressed by the surfaces (19) forcing the balls (16) inwardly into the end (10) of the handle (3). Once the handle (3) has moved over-centre the compression spring again expands forcing the balls (16) outwardly until in a position similar to that shown in FIG. 3 to close the split ring in the opposite direction to that described with reference to FIG. 2.

In both instances just described, that is, for the drive D and reverse R directions the relative position of spring force, balls (16) and surfaces (19) lock the split ring closed. When an opposite force is applied to the handle (3) in either operational condition the split ring releases from spigot (4*a*) to allow free rotation of the wrench about the spigot, as previously described with regard to the embodiments of FIGS. 1 through 8.

I claim:

1. A wrench comprising a head portion defining a circular aperture, a split ring sprung into said aperture and having spaced-apart end portions and a handle pivotally coupled to said head portion for moving said end portions together, said split ring having an abutment portion and a camming portion, said abutment portion being adapted to cooperate with a complementary abutment portion formed in said head portion to limit the available rotation of the split ring within the aperture, and said camming portion being adapted to cooperate with a complementary part on said pivotal lever for moving the spaced-apart end portions of the split ring together when said abutment portion of the split ring is abutting the complementary abutment portion on the head portion, and spring means biasing said handle in a sense to close said spaced apart end portions of the split pin together with a force greater than the spring force developed by the split ring itself.

2. A wrench as claimed in claim 1, wherein the spring means biasing the handle is located in the coupling between the head portion and the handle.

3. A wrench as claimed in claim 2, wherein the spring means is located in a passage extending through the coupling and complimentary apertures in the handle.

4. A wrench as claimed in claim 2, wherein opposed ends of the spring means are associated with detent means.

5. A wrench as claimed in claim 4, wherein the detent means comprises a ball located at each of two opposed ends of the spring means, respectively, for engagement with a respective protrusion on the head portion.

6. A wrench as claimed in claim 5, wherein each protrusion extends towards the other in an elongate slotted portion of the head portion in which an end portion of the handle is coupled to the head portion.

7. A wrench as claimed in claim 5, including two recesses on either side of each protrusion for receiving therein a respective one of the balls when the handle is in a drive or a reverse drive position.

8. A wrench as claimed in claim 5 wherein each protrusion extends from a planar side wall.

9. A wrench as claimed in claim 5, wherein each protrusion extends from a planar side wall having a recess on either side of the protrusion.

10. A wrench as claimed in claim 5, wherein the side walls from which the protrusion extends are substantially curved.

11. A wrench as claimed in claim 1, wherein the spring means is a compression spring.

12. A wrench as claimed in claim 1, wherein the complimentary part on said pivotal lever for moving the spaced apart end portions of the split ring towards each other comprises end walls of a slot at the inner-most end of the handle within the head portion, the slot extending in a transverse direction relative to a longitudinal axis of the handle.

13. A wrench as claimed in claim 9, wherein the spaced apart end portions of the split ring each comprise a land extending in both a radially outward direction and a circumferential direction, to define a camming arm contiguous the split in the split ring and the abutment portion at the circumferentially opposed end of the land to the respective camming arm, wherein the camming arms project into the transverse slot of the handle for engagement, as necessary, by an end wall of the transverse slot.

14. A wrench comprising a head for engaging a fastener or fastening device and a handle for applying torque to the head to turn a fastener, a resilient split ring located in an aperture through the head, the split ring being sprung into the aperture and operable by the handle between a first open position for free rotation of the wrench about the fastener or fastening devices, and a second closed position for clamping and moving the fastener, and detent means for automatically biasing the wrench into a closed position of the split ring, wherein the biasing force of the detent means is greater than the spring force within the split ring.

* * * * *